US005122071A

United States Patent [19]

Pridgeon et al.

[11] Patent Number: 5,122,071

[45] Date of Patent: Jun. 16, 1992

[54] GUARDIAN OUTLET COVER

[76] Inventors: Jay G. Pridgeon, 42 Nicholson Dr., Pasadena, Md. 21122; George Spector, 233 Broadway, New York, N.Y. 10007

[21] Appl. No.: 586,296

[22] Filed: Sep. 21, 1990

[51] Int. Cl.[5] ..... H01R 13/44

[52] U.S. Cl. ..... 439/143; 439/136; 174/67

[58] Field of Search ..... 439/135, 136, 137, 142, 439/143, 145, 149, 373; 174/66, 67

[56] References Cited

U.S. PATENT DOCUMENTS

| | | | |
|---|---|---|---|
| 2,119,428 | 5/1938 | Englar | 493/143 X |
| 2,641,627 | 6/1953 | Lewis | 439/143 X |
| 4,584,430 | 4/1986 | Belknap | 439/143 |
| 4,743,206 | 5/1988 | Imhoff | 439/143 X |

FOREIGN PATENT DOCUMENTS

| | | | |
|---|---|---|---|
| 0914991 | 7/1954 | Fed. Rep. of Germany | 439/137 |

*Primary Examiner*—Larry I. Schwartz
*Assistant Examiner*—Khiem Nguyen

[57] ABSTRACT

A safety cover plate for an electrical receptacle is provided and consists of a base member having spaced slots therein in alignment with spaced slots in the receptacle when the base member is attached to the receptacle in a wall. A protector member has spaced slots therein which is rotatably affixed to the base member over the spaced slots in the base member and is normally biased so that the spaced slots of the protector member are out of alignment with the spaced slots in the base member to prevent foreign objects from being inserted into the slots of the receptacle by a small child.

2 Claims, 1 Drawing Sheet

GUARDIAN OUTLET COVER

BACKGROUND OF THE INVENTION

The instant invention relates generally to electrical outlets and more specifically it relates to a safety cover plate for an electrical wall receptacle which provides protection for preventing a small child from having access to the electrical wall receptacle.

There are available various conventional electrical outlets which do not provide the novel improvements of the invention herein disclosed.

SUMMARY OF THE INVENTION

A primary object of the present invention is to provide a safety cover plate for an electrical wall receptacle that will overcome the shortcomings of the prior art devices.

Another object is to provide a safety cover plate for an electrical wall receptacle that contains a pair of rotatable protector members having slots which are normally biased to be out of alignment with the slots in a base member so that foreign objects cannot be inserted into the slots in the electrical wall receptacle.

An additional object is to provide a safety cover plate for an electrical wall receptacle whereby the blades of an electrical plug can be inserted within the slots in each rotatable protector members to turn the rotatable protector member and align with the slots in the base member so that the blades of the electrical plug can be inserted all the way into the slots of the electrical receptacle to make contact therein.

A further object is to provide a safety cover plate for an electrical wall receptacle that is simple and easy to use.

A still further object is to provide a safety cover plate for an electrical wall receptacle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
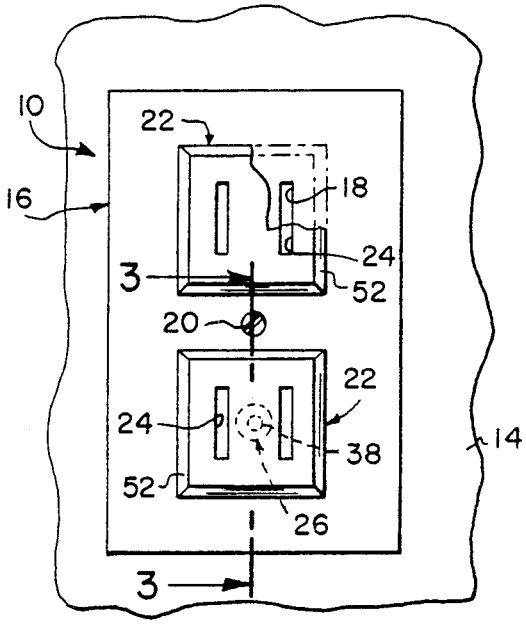
FIG. 1 is a front view of the invention showing the protector member slots in alignment with the slots in the base member so that electrical plugs can be inserted therein.
Figure 2:
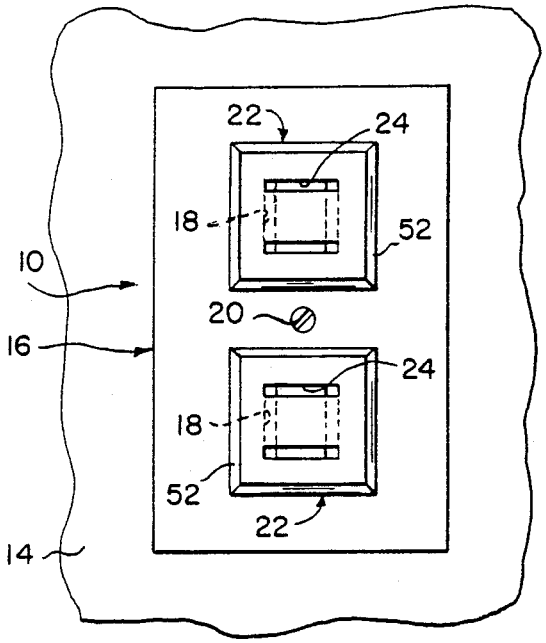
FIG. 2 is a front view of the invention showing the protector member slots normally out of alignment with the slots in the base member so that foreign objects cannot be inserted therethrough.

Turning now descriptively to the drawings, in which similar reference characters denote similar elements throughout the several views, the Figures illustrate a safety cover plate 10 for an electrical receptacle 12 in a wall 14. The receptacle 12 has two sets of spaced slots for receiving the blades of an electrical plug. The safety cover plate 10 consists of a base member 16 having two sets of spaced slots 18 therein in alignment with the spaced slots in the receptacle 12. A screw 20 is for attaching the base member 16 to the receptacle 12 in the wall 14. Two protector members 22 are provided in which each have spaced slots 24 therein. Each protector member 22 has a structure 26 for rotatably affixing the protector member 22 to the base member 16 over the spaced slots 18 in the base member.

A mechanism 28 is for normally biasing the spaced slots 24 of each protector member 22 out of alignment with the spaced slots 18 in the base member 16 to prevent foreign objects from being inserted into the slots of the receptacle 12 by a small child. The blades of the electrical plug can be inserted within the spaced slots 24 of each protector member 22 to rotate the protector member and place the spaced slots 24 of said protector member 22 in alignment with the spaced slots 18 in the base member 16 allowing the blades of the plug to be inserted all the way into the spaced slots in the receptacle 12.

The biasing mechanism 28 includes each protector member 22 a recess 30 formed in the back thereof. A torsion spring 32 is carried on the rotatably affixing structure 26 within the recess 30 in each protector member 22. The torsion spring 32 has one end 34 affixed to the protector member 22 and another end 36 affixed to the base member 16 to normally bias the spaced slots 24 of the protector member 22 out of alignment with the spaced slots 18 in the base member 16.

Figure 3:
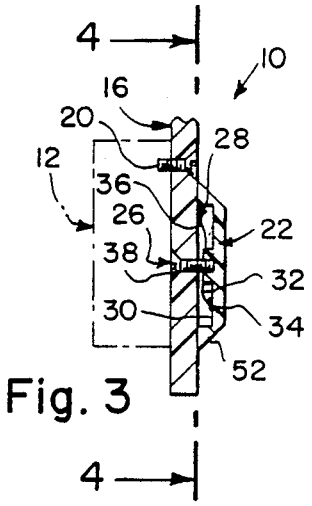
FIG. 3 is a cross sectional view taken along line 3—3 in FIG. 1, showing the internal biasing spring within the protector member.
Figure 4:
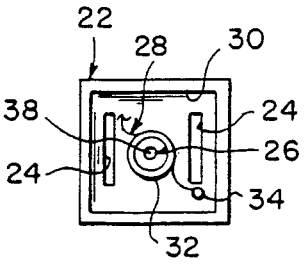
FIG. 4 is a cross sectional view taken along line 4—4 in FIG. 1, showing the rear of the protector member with the biasing spring therein.

As best seen in FIG. 3, the rotatably affixing structure 26 is a rivet 38 extending through the back of the base member 16 and into the center of the protector member 22.

Figure 5:
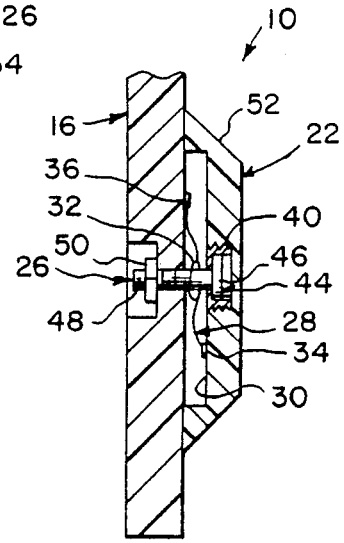
FIG. 5 is a cross sectional view, similar to FIG. 3, of a modification wherein means for adjustably securing the protector member rotatably to the base member is provided for convenient adjustment.

As best seen in FIG. 5, the rotatably affixing structure 26 includes an externally threaded hub 40 threaded into the center of the recess 30 in the back of the protector member 22. A bolt 44 having a head 46 is held within the hub 40. The threaded shaft 48 of the bolt 44 extends into the base member 16. A nut 50 is engagable with the threaded shaft 48 on the bolt 44 so that the nut 50 can be tightened on the threaded shaft 48 allowing the protector member 22 to be positioned thereto.

The edges 52 of each protector member 22 can be beveled to make it difficult for the little hands of the small child to turn the protector member 22.

The rivet 38, bolt 44, nut 50 and torsion spring 32 are preferably fabricated out of a non-metallic material to prevent an accidental electric shock when the blades of the electrical plug and inserted within the safety cover plate 10. The safety cover plate 10 can also be designed to be used with electrical plugs that have two blades and a grounding prong.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A safety cover plate for an electrical receptacle in a wall, the receptacle having spaced slots for receiving the blades of an electrical plug, said safety cover plate comprising:

a) a base member having spaced slots therein in alignment with the spaced slots in the receptacle;

b) a screw for attaching said base member to the receptacle in the wall;

c) a protector member having spaces slots therein;

d) means for rotatably mounting said protector member to said base member concentrically about said spaced slots in said base member;

e) means for concentrically retaining said spaced slots of said protector member in a first position out of alignment with the spaced slots in said base member to prevent foreign objects from being inserted into the slots of the receptacle by a small child, whereby the blades of the electrical plug can be inserted within the spaced slots of said protector member for manual actuation thereof concentrically to a second position whereby the spaced slots of said protector member are in alignment with the spaced slots in said base member allowing the blades of the plug to be inserted all the way into the spaced slots in the receptacle; whereby said means will return said protector member to said first position upon removal of said blades from said cover plate; wherein said biasing means includes:

f) said protector member having a recess formed in the back thereof; and g) a torsion spring carried on said rotatably affixed means with said recess in said protector member, whereby said torsion spring has one end affixed to protector member and another end affixed to said base member to normally bias the spaced slots of said protector member to said first position out of alignment with the spaced slots in said base member.

2. A safety cover plate as recited in claim 1, wherein said rotatably affixing means includes:

a) an externally threaded hub threaded into the center of the recess in the back of said protector member;

b) a bolt having a head retained concentrically within said hub and a concentrically threaded shaft extending into said base member; and c) a nut engagable with the threaded shaft of said bolt so that said nut can be tightened on said threaded shaft allowing said protector member to be rotatably mounted thereon.

* * * * *